US006842599B2

(12) United States Patent
Shibata et al.

(10) Patent No.: US 6,842,599 B2
(45) Date of Patent: Jan. 11, 2005

(54) LIQUID DEVELOPING SYSTEM DEVELOPING DEVICE

(75) Inventors: Hideaki Shibata, Kanazawa (JP); Hitoshi Terashima, Kanazawa (JP); Satoru Moto, Kanazawa (JP); Masanari Takabatake, Kanazawa (JP); Motoharu Ichida, Tsubata-machi (JP); Yasuhiko Kishimoto, Uchinada-machi (JP); Tatsuo Nozaki, Unoke-machi (JP); Masanobu Hongo, Unoke-machi (JP); Yutaka Nakashima, Kanazawa (JP); Akihiko Inamoto, Uchinada-machi (JP); Tadashi Nishikawa, Tsubata-machi (JP); Norihiro Yamasaku, Oyabe (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 10/466,470

(22) PCT Filed: Aug. 5, 2002

(86) PCT No.: PCT/JP02/07948

§ 371 (c)(1),
(2), (4) Date: Jul. 16, 2003

(87) PCT Pub. No.: WO03/021361

PCT Pub. Date: Mar. 13, 2003

(65) Prior Publication Data

US 2004/0057754 A1 Mar. 25, 2004

(30) Foreign Application Priority Data

Aug. 30, 2001 (JP) ..... 2001-260946
Dec. 21, 2001 (JP) ..... 2001-388658

(51) Int. Cl.[7] ..... G03G 15/10
(52) U.S. Cl. ..... 399/237
(58) Field of Search ..... 399/57, 237, 239, 399/240, 241, 243, 247, 248, 238

(56) References Cited

U.S. PATENT DOCUMENTS

| | | | | | |
|---|---|---|---|---|---|
| 3,917,880 | A | * | 11/1975 | Wells et al. | 399/2 |
| 5,826,148 | A | * | 10/1998 | Iino et al. | 399/240 |
| 6,038,421 | A | * | 3/2000 | Yoshino et al. | 399/239 |
| 6,072,972 | A | * | 6/2000 | Obu et al. | 399/237 |
| 6,256,468 | B1 | * | 7/2001 | Liu | 399/237 |
| 6,311,034 | B1 | * | 10/2001 | Nakashima et al. | 399/239 |

FOREIGN PATENT DOCUMENTS

| | | |
|---|---|---|
| JP | 03-279986 | 12/1991 |
| JP | 7-287450 | 10/1995 |
| JP | 11-194622 | 7/1999 |
| JP | 11-194623 | 7/1999 |
| JP | 2000-056576 | 2/2000 |
| JP | 2000-250321 | 9/2000 |
| JP | 2002-278300 | 9/2002 |
| WO | WO 01/88630 A1 | 11/2001 |

* cited by examiner

*Primary Examiner*—Sandra Brase

(57) ABSTRACT

An electrode module in the form of a flexible sheet which contacts with a toner layer and to which a bias voltage is applied is provided on a developing roller before development. The electrode module is adapted to separate the toner layer largely into a toner-rich layer and a carrier-rich layer by utilizing electrical migration occurring in the toner layer when an electric field is applied to the toner layer on the basis of the bias voltage. The electrode module is constructed in such a manner that the sheet is pulled toward a surface of the developer bearer body by a force attributable to surface tension or wetting characteristic of the liquid developer existing between the sheet and the developer carrying body, whereby the sheet comes into contact with the surface of the developer bearer body. This electrode construction increases the contact area or nip width of a bias blade provided for the developing roller and enhances its contact stability.

17 Claims, 10 Drawing Sheets

Configuration of Bias Blade Electrode (Winding Type)

Configuration of Developing Unit

Configuration of Bias Blade Electrode (Winding Type)

Configuration of Bias Blade Electrode

Configuration of Bias Blade Electrode

Configuration of Developing Unit

Relation between Oil Viscosity and Leakage Start Flow Rate

When Roller is stopped

When Roller is rotated

Pump Control Timing

LIQUID DEVELOPING SYSTEM DEVELOPING DEVICE

TECHNICAL FIELD

The present invention relates to a developing unit for a liquid-development process in which a developing roller carrying a toner layer of liquid developer formed thereon is disposed so as to face a photosensitive body in such a manner that toner particles of the liquid developer are caused to adhere to the photosensitive body in a selective pattern corresponding to a recorded latent image.

BACKGROUND ART

A conventional developing unit using a liquid developer has a structure in which, as shown in FIG. 17, an electrically conductive sheet called a bias blade is disposed on a developing roller and adapted to be biased (see International Patent Application Laid-Open No. WO 01/88630 A1).

As shown in FIG. 18, which depicts the bias blade of FIG. 17 and its associated components in detail, one end of the bias blade is held by a bracket of metal, etc., and the other end of the bias blade is in contact with a liquid developer bearer body in the form of, for example, a developing roller or belt. The bias blade serves to separate the toner layer into a toner cohesion layer that is rich in toner and has a high viscosity, and a quasi-prewet layer that is rich in carrier, by means of electrically migrating the toner particles under application of a bias voltage to the toner layer previously formed on the developing roller. The force causing this toner separation is derived from an electric field induced by the applied bias voltage and is attributed to the electrical migration phenomenon in which toner particles; i.e., electrically charged particles, move under influence of the electric field.

As is apparent from its function, the bias blade must exhibit not only flexibility for holding the toner layer in position and allowing the toner layer to pass through, but also electrical conductivity for inducing an electric field. In terms of flexibility in particular, the type of bias blade to be employed must be determined by comparison with the hardness of the developing roller, but in practice the type of bias blade is selected in view of whether the bias blade allows the toner layer to pass through.

Conventionally, a bias blade is manufactured by molding and cutting a relatively thin sheet of rubber or plastic into a desired shape and must be adjusted in electrical resistance with respect to the resistance of the developing unit. Further, a bias blade must allow a very thin toner layer to pass through, depending on the thickness of the layer of a liquid developer to be used. Generally, the amount of liquid that is allowed to pass depends on applied mechanical pressure, viscosity, and speed. For example, when an ordinary elastic rubber is used, the bias blade has the following relation. The amount of liquid allowed to pass is 20 im in the case where roller rubber hardness: 40 (JIS-A); oil viscosity: 20 cSt; and speed: 250 mm/s.

Furthermore, in terms of the function of a bias blade, a bias blade must have a shape designed so as not to rupture or separate toner, in order to prevent formation of any rivulet. A rivulet refers to a stripe-shaped non-uniform layer (irregularity) which is formed as a result of derangement of a layer of a liquid developer attributable to viscosity of toner when the liquid developer layer is broken and separated at the exit of the blade. When such a rivulet is formed, image quality deteriorates or the image encounters fogging. Consequently, instead of a tip-side edge of a blade, a belly portion of the blade adjacent to the tip-side edge must be pressed against the developing roller. For this purpose, the bias blade assumes the shape shown in FIG. 18.

As described above, there has been desired a method for stably applying an electric field to the toner layer so as to maintain passage of a proper amount of toner without breakage and separation of toner, which would result in formation of a rivulet. Further, since the bias blade utilizes an electrical migration phenomenon, the length of contact between the blade and the developing roller (the length of contact in the moving direction: the nip width) must be increased in order to increase a period of time for movement by migration. However, when the manner of contact of the bias blade is determined so as to suppress breakage and separation of toner at the tip end to thereby prevent formation of rivulets, in many cases, it becomes difficult to increase the nip width of the blade.

Conventionally, a blade is positioned in such a manner that the blade comes into contact with a toner layer in an area starting from a belly portion of the blade to a point very close to the tip-side edge thereof. Therefore, adjustment of the position of the blade has been difficult. When the tip-side edge of the blade comes into direct contact with a toner layer, toner is not permitted to pass through such a contact zone and is scraped off by the blade, which results in formation of a stripe in a developed image. In contrast, when the blade is separated from the toner layer at a position spaced too far from the tip-side edge, formation of a rivulet occurs.

Further, conventionally, high voltage is supplied from a power source to the bias blade, and therefore, means for limiting current must be provided in order to protect the developing roller.

Japanese Patent Application Laid-Open (kokai) No. H7-287450 discloses an alternative method for disposing a bias-applied electrode in opposition to a developing roller. In the method disclosed in this publication, a rigid electrode having a cylindrical inner surface is disposed so as to face the developing roller with high precision. However, in the case in which a toner layer has a thickness on the order of 10 im, a very small gap corresponding to such a thin layer is very difficult to form through only mechanical machining.

In addition, as described above, a liquid toner is applied onto a developing roller, and a latent image on a photosensitive body is developed by use of this liquid toner. However, because of its high viscosity and high concentration, the liquid toner often fails to be uniformly applied onto the developing roller unless a sufficient amount of liquid toner is uniformly conveyed and applied to the developing roller.

FIG. 19 is an illustration showing a conventional construction for feeding a high-viscosity, high-concentration liquid toner. A liquid toner is supplied from a feed tray to a developing roller via a toner applicator roller (a patterned roller). If a patterned roller having an engraved pattern of cells is employed as the toner applicator roller, excessive toner is scraped off the patterned roller by a scraper blade. By virtue of this construction, if the entire developing unit is tilted or if excess toner is supplied, the toner would be prone to leak, thereby contaminating the unit, a printing medium, etc.

Consequently, the present applicant previously proposed a liquid toner supply arrangement as shown in FIG. 20 (Japanese Patent Application No. 2001-77440). A liquid toner is supplied onto a surface of a developing roller from a patterned roller whose circumferential surface is moving in the same direction as the developing roller's circumferential surface (i.e., in the forward rotational direction) at the contact zone. Because the liquid toner is conveyed with the assistance of the circumferential grooves on the pattern roller, a constant amount of toner can be applied, which amount is restricted by only the number and size (cross-sectional area) of the grooves. The toner applied to the patterned roller is supplied from the toner feed tray.

As described above, the patterned roller is disposed in such a positional relation with the toner feed tray as to close its open side. Further, a scraper blade is disposed on the patterned roller at a position downstream of the toner feed tray and is normally pressed against the patterned roller under constant pressure by means of the resilience of a spring, so that the toner can be conveyed and applied onto the developing roller uniformly.

In this illustrated conventional construction, the gaps between the patterned roller and nearby parts are tightly covered by means of seals (illustrated seals 1 and 2) from all sides. Practically, a toner vessel is statically sealed by a cylindrical casing, sponge rubber, etc. Although this method enables provision of a structure which can prevent leakage irrespective of attachment angle, a rubber member for sealing comes into contact with portions other than the scraper blade and, therefore, cohesion of toner occurs at these portions. This toner cohesion causes variation in toner concentration, with the result that the image suffers irregularity and stripes, thereby deteriorating image quality.

The developing process will now be described in more detail. The proper amount of toner to be applied onto the developing roller is determined in terms of volume of the engraved cells of the patterned roller. Notably, the amount of toner is determined by the pressure of contact and the shape of cells; however, in general, not all the toner in the cells is fully transferred to the developing roller. Namely, a certain part of toner fails to be transferred and remains in the cells of the patterned roller after these cells have passed the developing roller. Although this does not pose a serious problem, the toner concentration is apt to change or the residual toner is apt to be scraped off subsequently when the toner comes into engagement with the sealing materials, etc. that are provided for tightly closing the above-described gaps. Either problem can be eliminated when the patterned roller passes the standing toner in the toner feed tray. In actuality, this phenomenon does not occur while the patterned roller is rotating at relatively low speed.

Nonetheless, when a sufficiently high printing speed is required, the circumferential speed of the patterned roller also inevitably becomes higher. In such a case, since the period of time for the patterned roller to pass through the standing toner is short, the above-described phenomenon cannot be completely eliminated; consequently, the resulting image still suffers irregularity and stripes.

As described hereinabove, when sponge rubber and sealing rubber used for constituting a closed structure come into engagement with the patterned roller, solid components of tone cohere locally, with the result that intended uniform application of toner cannot be achieved by means of the scraper blade.

DISCLOSURE OF THE INVENTION

Accordingly, an object of the present invention is to provide a developing unit for a high-speed developing process, which unit is easy to assemble and scarcely suffers fogging (dirt in background).

Another object of the present invention is to increase, in a developing roller equipped with a bias blade, the nip width of the bias blade and to stabilize the contact of the bias blade with the developing roller, thereby enhancing the effect of using the bias blade.

Still another object of the present invention is to prevent not only deterioration of image quality but also stagnation and leakage of toner, as well as to simplify the developing unit by shared use of a part or parts thereof.

The present invention provides a developing unit for a liquid-development process in which a developer bearer body carrying a toner layer of liquid developer formed thereon is disposed to face an image bearer body in such a manner that toner particles of the liquid developer are caused to adhere to the image bearer body in a selective pattern corresponding to a recorded latent image. Further, the developing unit includes an electrode module in the form of a flexible sheet which is adapted to contact the toner layer on the developer carrying body before development and to which a bias voltage is applied. The electrode module acts to separate the toner layer into a toner-rich layer and a carrier-rich layer by utilizing electrical migration occurring in the toner layer when an electric field is applied to the toner layer on the basis of the bias voltage. The electrode module is constructed in such a manner that the sheet is pulled toward a surface of the developer bearer body by a force attributable to surface tension and/or wetting characteristic of the liquid developer existing between the sheet and the developer carrying body, whereby the sheet comes into contact with the surface of the developer bearer body.

The developing unit for a liquid-development process according to the present invention further includes a patterned roller serving to apply the liquid developer to the developer bearer body while the patterned roller is rotating in contact therewith; a toner feed tray serving to supply the liquid developer to a surface of the patterned roller; and control means for controlling the rotation of the patterned roller and the supply of the liquid developer. The patterned roller has a structure such that its circumferential surface is free from contact with any components of the developing unit, other than the developer bearer body and a scraper blade. The toner feed tray has a length greater than the transverse length of the patterned roller and a width for covering a portion of the circumference of the patterned roller, is disposed to face the surface of the patterned roller with a gap formed therebetween, and is configured to enable the liquid developer to be fed to the gap and discharged from the gap in a circulating manner. When the liquid developer is supplied to said toner feed tray, the control means effects the supply while rotating the patterned roller, in order to convey the liquid developer onto the patterned roller without any leakage of the liquid developer from the toner feed tray.

BEST MODE FOR CARRYING OUT THE INVENTION

Figure 1:
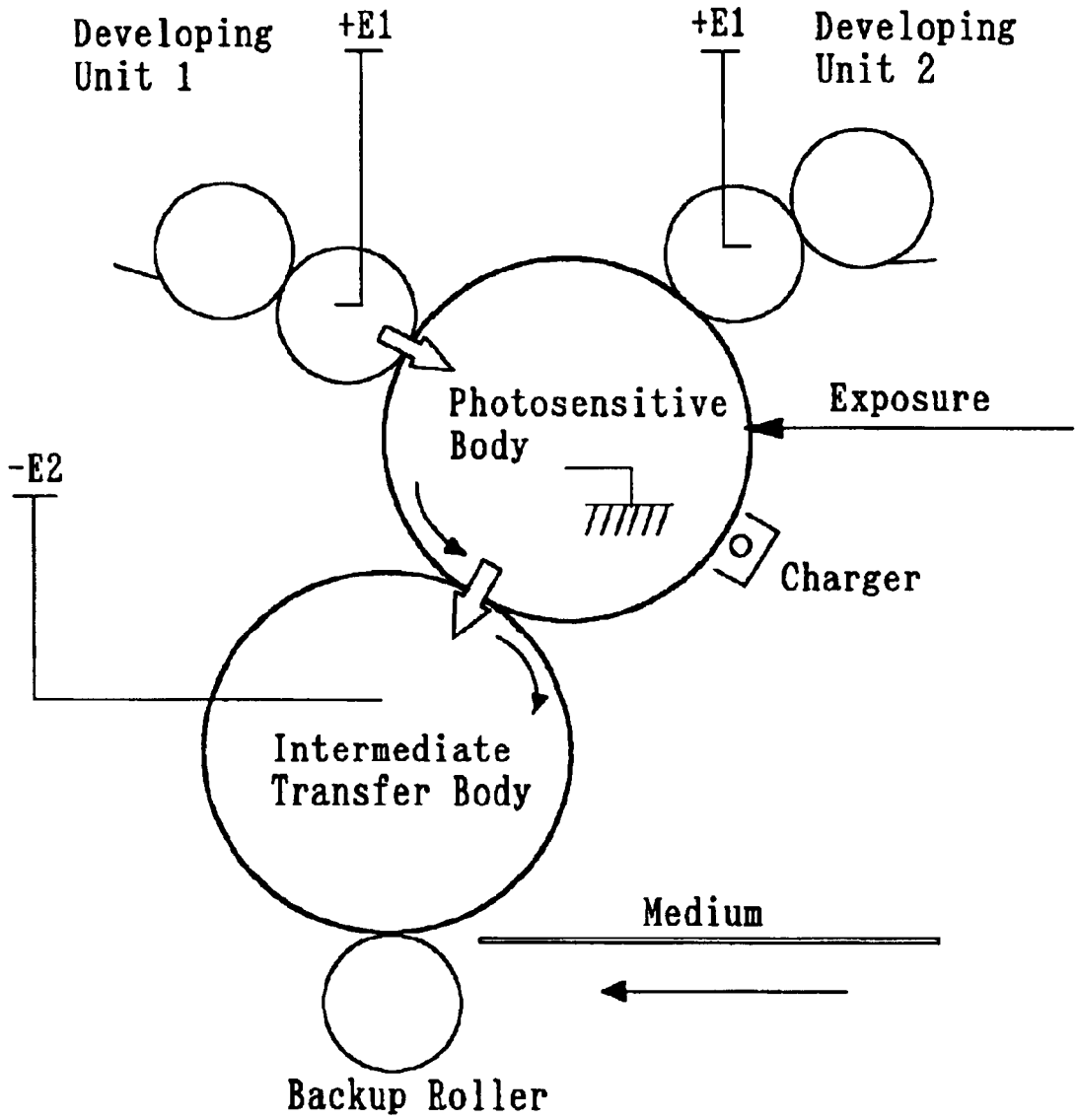
FIG. 1 is a view showing the overall construction of an electrophotographic apparatus employing a liquid toner, to which apparatus the present invention is applicable.

Embodiments of the present invention will now be described in detail. FIG. 1 shows the overall construction of an electrophotographic apparatus using a liquid toner to which the present invention is applicable. As illustrated here, the electrophotographic apparatus is equipped with a photosensitive body; a charger; an exposure device; a plurality of developing units, one for each of necessary colors (only two units are shown); an intermediate transfer body; and a backup roller.

The charger electrically charges the photosensitive body up to approximately 700 V. The exposure device exposes the photosensitive body using laser light or LEDs, to thereby form on the photosensitive body an electrostatic latent image in a pattern of exposed areas whose potential becomes approximately 100 V.

The developing units are usually assigned one to each of yellow, magenta, cyan, and black; each developing unit is biased to approximately 400 V (+E1) and is adapted to form a toner layer having a thickness of 2 to 3 im on a developing roller, from a liquid toner having a toner viscosity of 400 to 4000 mPa.S and a carrier viscosity of 20 cSt. In accordance with an electric field acting between the developing roller and the photosensitive body, the developing roller supplies the positively-charged toner particles to the photosensitive body, whereby the toner particles adhere to the exposed areas (or unexposed areas) of the photosensitive body, the areas having attained a potential of approximately 100 V.

The intermediate transfer body is biased to approximately −800 V (−E2). The toner adhering to the photosensitive body is transferred to the intermediate transfer body in accordance with the electric field acting between the intermediate transfer body and the photosensitive body. For example, yellow toner adhering to the photosensitive body is first transferred to the intermediate transfer body; magenta toner adhering to the photosensitive body is then transferred to the intermediate transfer body; and cyan toner and black toner are successively transferred to the intermediate transfer body.

The color toners adhering to the intermediate transfer body are melted upon heating by an unillustrated heating device. Meanwhile, the backup roller serves to assist in transferring the molten toners from the intermediate transfer body onto a printing medium, and then fixing the transferred toner.

Figure 2:
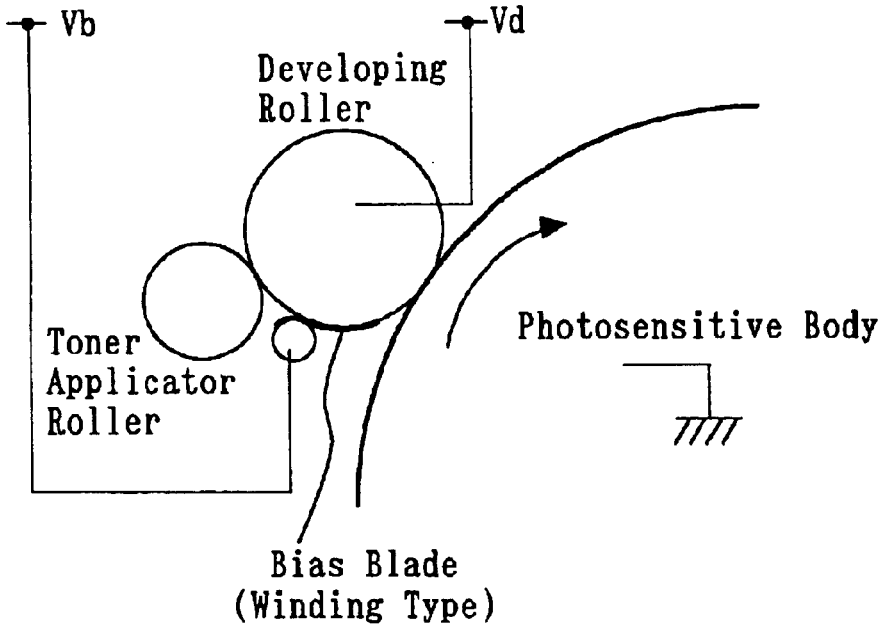
FIG. 2 is a view showing the construction of a developing unit for a highly-viscous-liquid-development process to which unit the present invention is applied.
Figure 17:
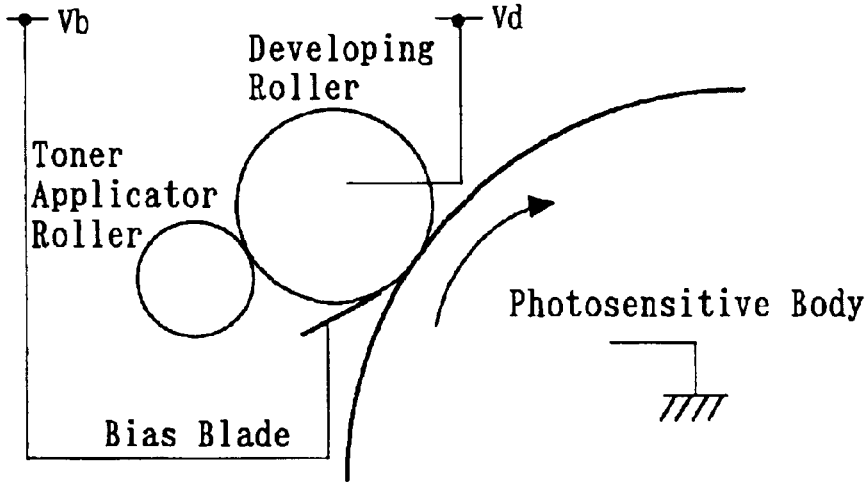
Fig.17 Prior Art
FIG. 17 is a view showing the arrangement in which a bias voltage is applied to a developing roller according to the conventional art.
Figure 18:
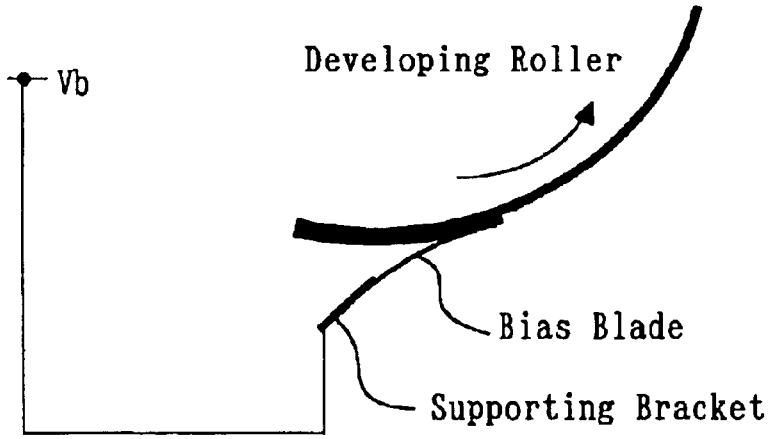
Fig.18 Prior Art
FIG. 18 is a detailed view of a portion of FIG. 17, showing a bias blade and its associated parts.
Figure 19:
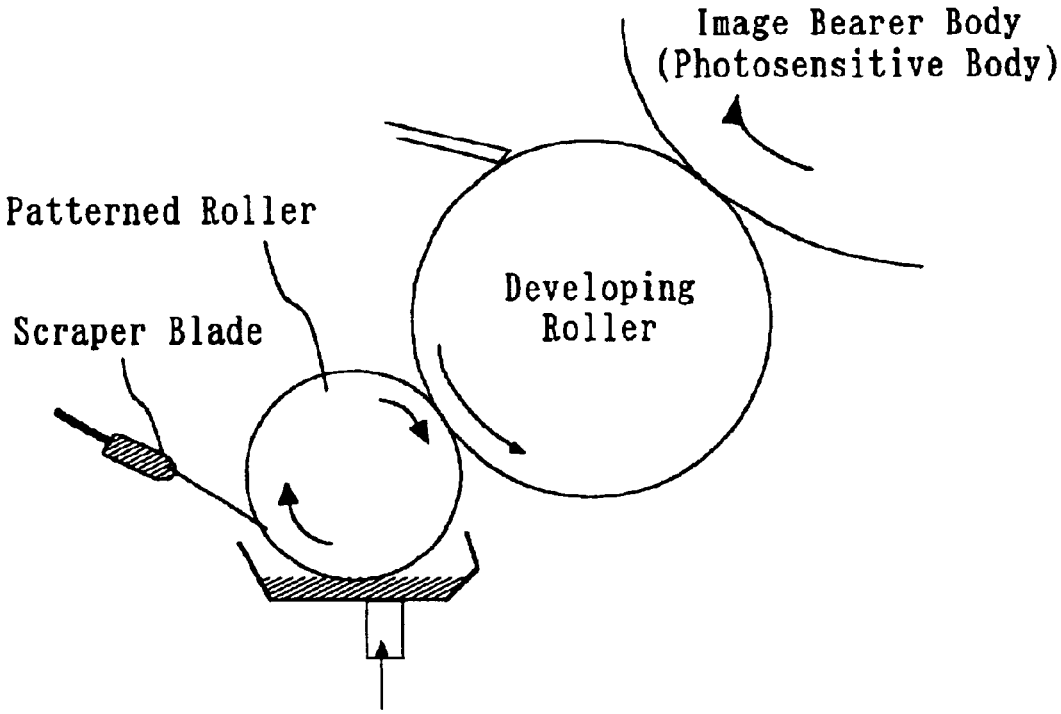
Fig.19 Prior Art
FIG. 19 is a view showing a conventional arrangement for supplying a high-viscosity, high-concentration liquid toner.
Figure 20:
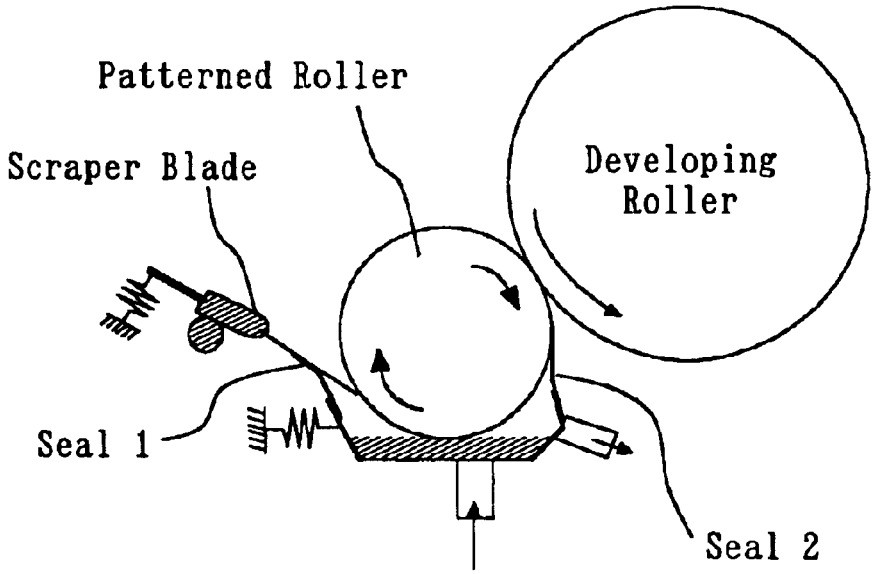
FIG. 20 is a view showing a liquid toner supply arrangement previously proposed by the present applicant.

FIG. 2 is a view showing a developing unit for a high-viscosity-liquid development process to which unit the present invention is applicable. This illustrated developing unit is equipped with a bias blade. Like the conventional bias blade described above in connection with FIG. 17 or FIG. 18, the present bias blade serves to separate a toner layer on the developing roller at a position immediately upstream of the developing zone, into a toner-rich layer and a carrier-rich layer, by utilizing electrical migration in the toner layer when an electric field is applied to the bias blade.

Figure 3:
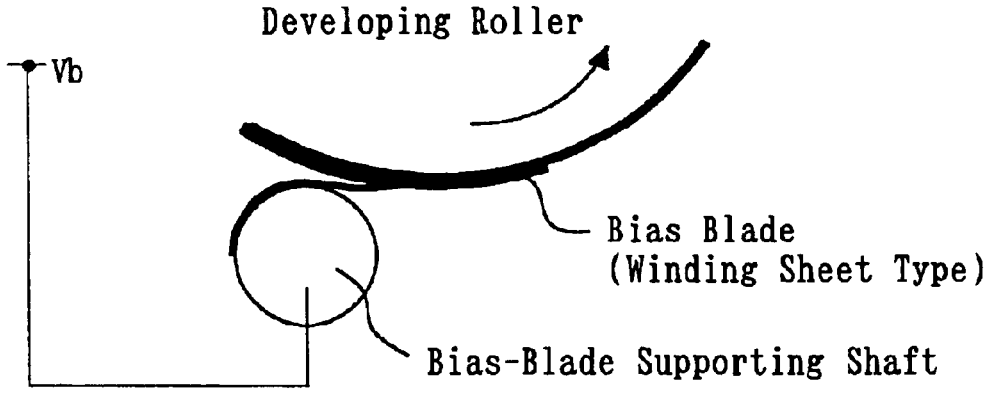
FIG. 3 is an enlarged view of a portion of FIG. 2, showing a bias blade and its associated parts.

In the present invention, a winding flexible sheet shown in FIG. 2 is employed as such a bias-blade electrode module. FIG. 3 is an enlarged view of a portion of FIG. 2, showing a bias blade and its associated parts. This flexible sheet has a greatly reduced bending strength and therefore has a high degree of flexibility. Therefore, in the case in which the bias blade is brought into contact with a lower surface of the developing roller as shown in FIG. 3, if no liquid developer is present on the developing roller, the bias blade hangs down under the influence of gravity, and does not come into contact with the developing roller. The bias blade of the present invention is constructed so as to strongly attract liquid toner to the surface of the developing roller with the assistance of forces attributable to surface tension or wetting characteristic of the liquid toner. For this purpose, the bias-blade electrode module assumes the form of a winding blade (sheet) that is to be wound on the developing roller. In the illustrated example, one end of the bias blade is attached to a conducting bias-blade supporting shaft in such a manner that a bias voltage Vb is applied to the bias blade and the bias blade can be wound on the developing roller through a predetermined length.

Notably, the bias blade usually separates a toner layer, before being subjected to development, into a layer characterized by high concentration of toner particles (solid components), and a layer characterized by low concentration of toner solid components and dominated by a carrier solvent, by means of electrical migration. However, the extent of this separation depends on the electrical migrating characteristic (mobility) of toner. The lower the mobility of toner, the smaller the effect that can be achieved. In order to enable obtainment of the effects of suppressing fogging and attaining high-speed response even when toner has low mobility, a period of time for application of an electric field must be increased. That is, the length of contact between the blade and the roller (nip width) must be increased. According to the present invention, the flexible sheet is pressed against the developing roller in order to secure a gap by utilizing the flow pressure of toner. Further, intimate contact is achieved between the sheet and the developing roller by the wetting characteristic of liquid. Therefore, the period of time over which continuous contact is achieved can be increased by a large extent.

Since the blade (sheet) of the present invention exhibits extremely low bending strength, the blade is pulled to the surface of the developing roller by the wettability of the blade with the toner layer on the developing roller, whereby the blade comes into intimate contact with the toner layer on the surface of the developing roller. At this time, the sheet is in intimate contact with the surface of the toner layer up to a tip-side edge of the sheet. Although this winding bias blade (sheet) must be designed to attain uniform contact over its entire area, it is unnecessary to consider (or adjust) the process for the sheet edge.

The bias blade (sheet) may be a thin metal plate whose resistance is approximately zero. For example, the bias blade may be formed of an SUS304 plate according to JIS, the plate having a thickness less than 1 mm, preferably 0.05 mm.

Alternatively, the bias blade (sheet) may assume the form of an electrically conductive low-resistance polymer sheet. For example, the polymer of this alternative sheet may be polyester, polycarbonate, polyimide, polyurethane or any other polymer, so long as electrical conductive properties are imparted. Preferably, a conductive polyethylene sheet, available under the name "Chlopolyfilm" from Achilles Corporation, may be used.

Further, carbon may be added to the polymer in order to impart conductive properties to the polymer. Alternatively, ions of lithium salt, sodium salt, or ammonium salt may be applied the polymer sheet in order to impart electrically conductive properties thereto.

Figure 4:
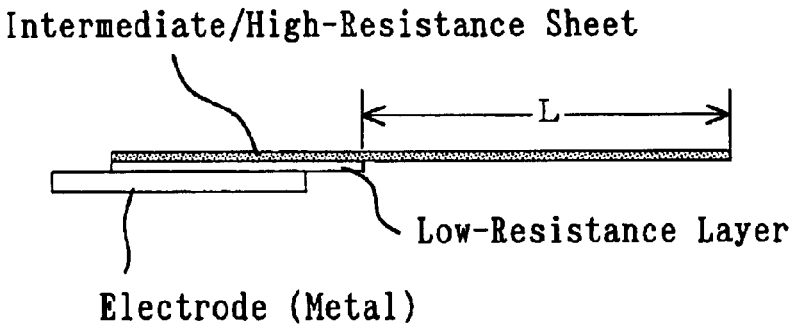
FIG. 4 is a view showing an example of the bias blade.
Figure 5:
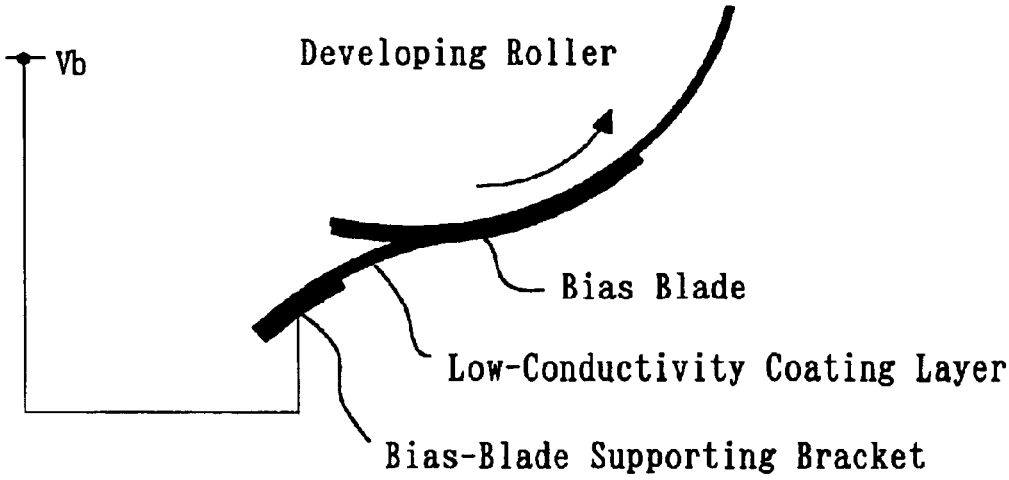
FIG. 5 is a view illustrating the manner in which the bias blade of FIG. 4 is used.

In another alternative form, as shown in FIG. 4, a sheet having an intermediate or high resistance is used as the bias blade, and a low-resistance layer is bonded to a backside of the sheet. FIG. 5 shows the manner in which this bias blade is used. The low-resistance layer may be a flexible conducting adhesive; for example, a conducting adhesive, which is available under the name TB-3150E from Three Bond Co. Ltd., may be coated over the blade, and the resulting blade left exposed to ambient air for a predetermined time so that a solvent evaporates out of the adhesive coating. Alternatively, the low-resistance layer may be a flexible thin metal plate, preferably of SUS304 stainless steel according to JIS.

The intermediate- and high-resistance sheet extends beyond the distal edge of the low-resistance layer by a length L (see FIG. 4); apparent resistance of the resulting bias blade can be adjusted by varying the length L.

Next, in relation to the method for application of voltage to the sheet, when a proper sheet resistance value is selected and a voltage is applied to the tip edge side of the sheet, an electric field acting on the sheet can be stronger toward its tip edge side and weaker toward its toner inlet side, depending on a voltage drop attributable to a current flowing into the sheet.

Figure 6:
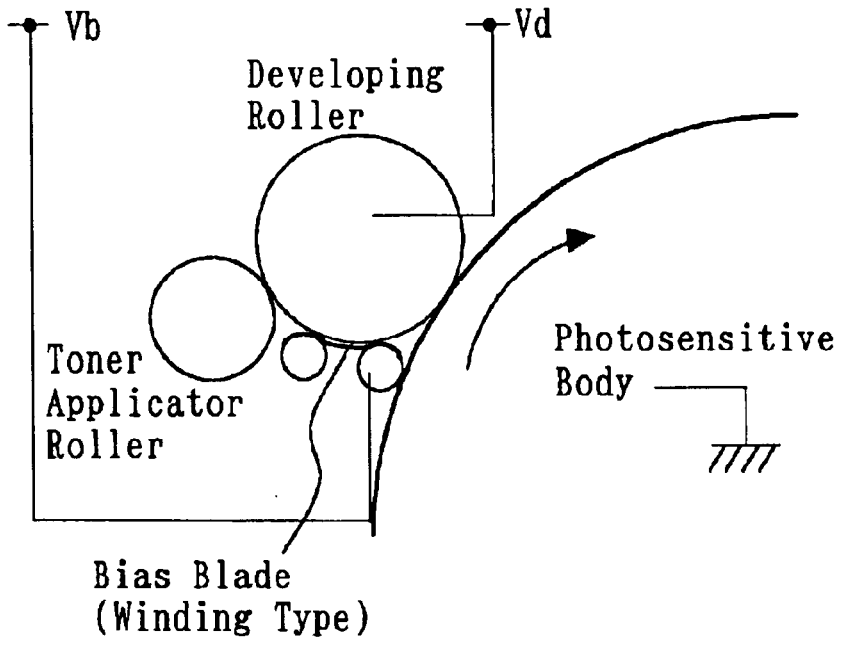
FIG. 6 is a view showing another developing unit, which differs from the developing unit of FIG. 2.

For the purpose of applying voltage to the tip edge side of the sheet, as shown in FIG. 6, the sheet assumes the form of a belt whose belly is pressed against the developing roller. Different voltages are applied to a pair of electrodes supporting the sheet in order to produce a potential difference between the electrodes in such a manner that the strength of the electric field applied to the toner particles decreases gradually from the toner-outlet side toward the toner inlet side of the sheet.

Figure 7:
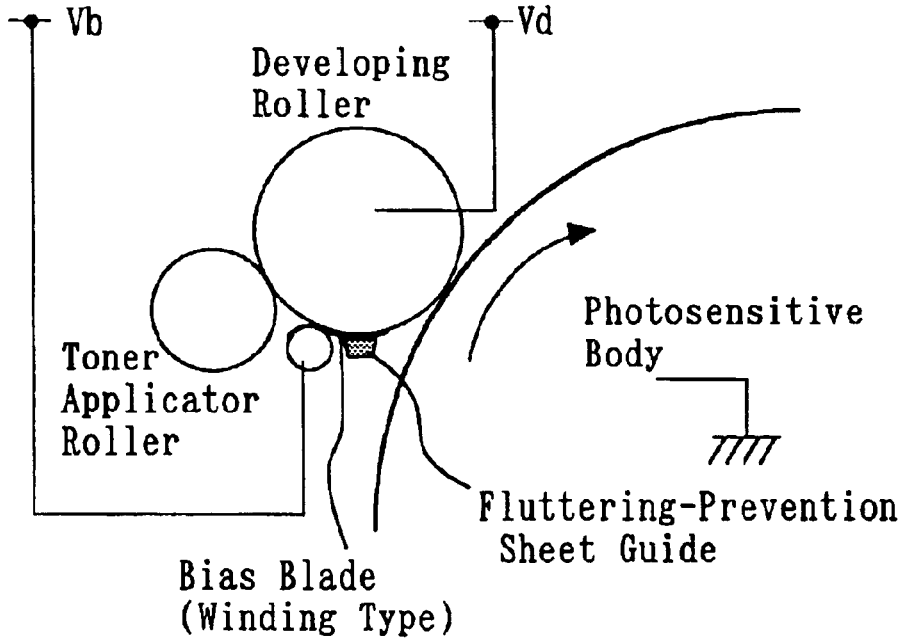
FIG. 7 is a view showing still another developing unit.

As shown in FIG. 7, a fluttering-prevention sheet guide may be provided for the purpose of suppressing a possible fluttering movement of the sheet in the absence of any toner on the developing roller, to thereby stabilize the position of the sheet.

Figure 8:
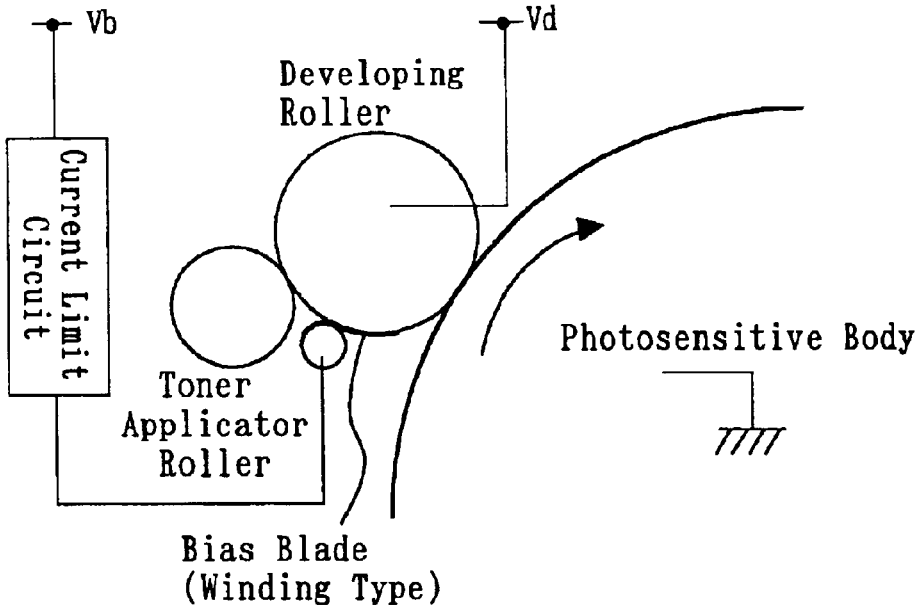
FIG. 8 is a view showing a bias-voltage application arrangement equipped with a current limit circuit.

The winding sheet of the present invention can have a sufficient length of contact (nip width) and, therefore, a voltage to be applied can be reduced. Accordingly, a circuit for limiting current becomes unnecessary, and thus the cost of a power source, etc. can be lowered. In an alternative case shown in FIG. 8, however, a possible overcurrent can be reliably limited by the provision of a current limit circuit in a bias voltage application section.

Figure 9:
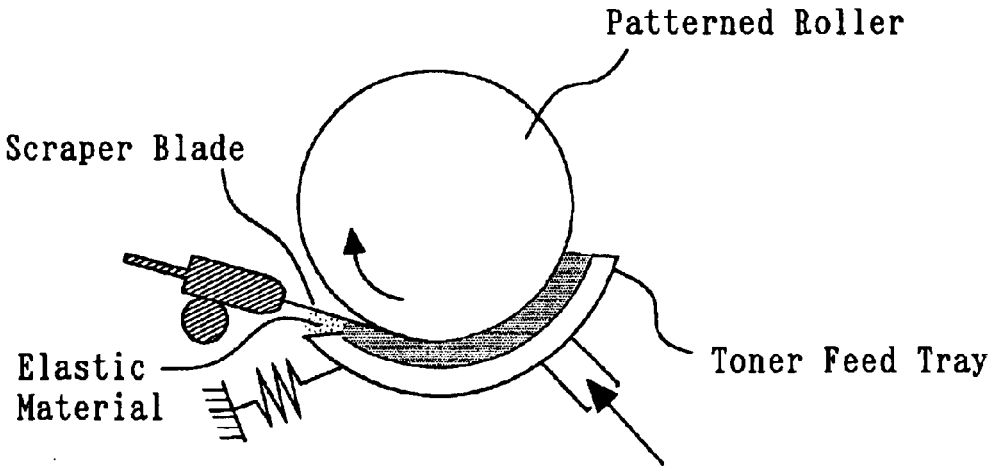
FIG. 9 is a view showing a first example of toner supply arrangement of the electrophotographic apparatus according to the present invention.
Figure 10:
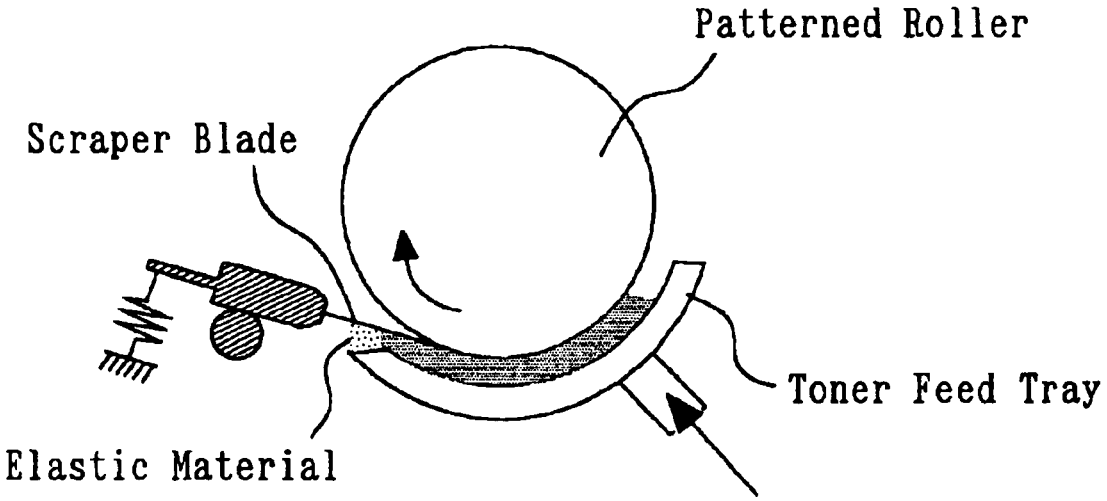
FIG. 10 is a view showing a second example of toner supply arrangement of the electrophotographic apparatus according to the present invention.

FIGS. 9 and 10 show first and second practical examples, respectively, of the toner supply arrangement of the electrophotographic apparatus according to the present invention. A patterned roller is employed as a toner applicator roller that is to come into contact with a developing roller to apply toner thereto. As shown in FIGS. 9 and 10, standing toner between a toner feed tray and the patterned roller is not tightly closed, and nothing that can come into contact with the circumferential surface of the patterned roller is provided thereon, except for the developing roller (not shown) and a scraper blade.

The patterned roller (e.g., Anilox roller of Asahi Roll) is a roller having, for example, a striped pattern of 100/inch to 350/inch grooves inclined with respect to the circumferential direction; or a fine latticework pattern which has additional grooves crossing the above-described grooves. The transfer of toner by use of these grooves of the patterned roller enables supply of toner at a constant rate, which is limited only by the number and size (cross-sectional area) of the grooves. Notably, an individual area surrounded by the grooves is called a cell. The toner to be supplied to the patterned roller originally comes from the toner feed tray.

By virtue of the thus-constructed patterned roller, when the patterned roller is rotated, toner can be supplied to the entire circumferential area of the patterned roller without leaking from the toner feed tray. Further, in an alternative form having an toner outlet as shown in FIG. 11, a constant amount of toner can be normally contained in the toner supply tray.

Figure 11:
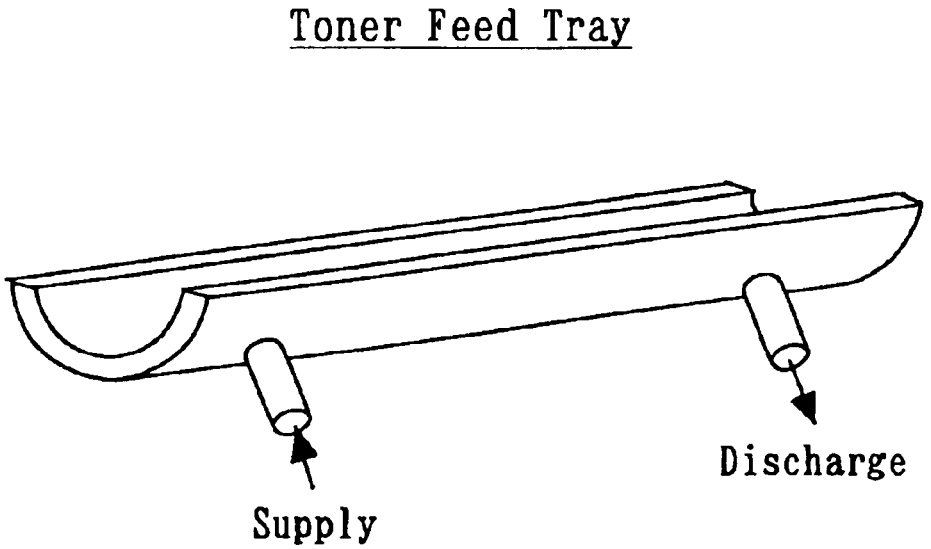
FIG. 11 is a view showing a toner feed tray.

FIG. 11 is an illustration showing an example of the toner feed tray. The tray of the illustrated example has an arcuate cross-sectional shape and is disposed so as to form a constant gap between the patterned roller and the tray. The toner feed tray has a length greater than the transverse length of the patterned roller and a width for covering a portion of the circumference of the patterned roller, and is disposed to face the surface of the patterned roller with a spacing between the tray and the patterned roller. As shown in this illustration, at any one of left and right ends of the tray, toner may be supplied from the bottom or side; and at the other end of the tray, toner may be discharged from the bottom or side. Alternatively, toner may be supplied to the toner feed tray from its central portion and discharged from its opposite ends. Notably, in terms of toner flow channel in the toner feed tray, apart from the spacing between the patterned roller and the feed tray, the feed tray may have in its bottom one or more longitudinal grooves for enhancing fluidity of toner.

Liquid toner supplied to the feed tray flows in the channel between the patterned roller and the feed tray, and the discharged liquid toner returns to a toner tank for subsequent use; this supplying and discharging procedure is repeated for the sake of recycling. As a result, liquid toner can be speedily conveyed onto the patterned roller uniformly without any leakage from the feed tray.

Figure 12:
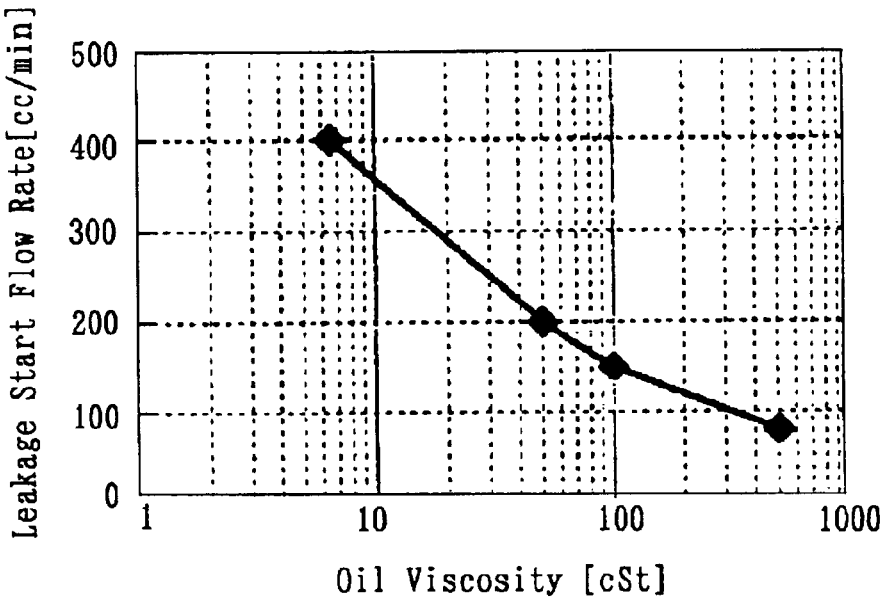
FIG. 12 is a graph showing a relation between oil viscosity and leakage start flow rate.

In practice, however, since the toner feed tray is not completely sealed, leakage of toner could occur, depending on the supplied amount and viscosity of toner, the circumferential speed of the patterned roller, and the shape of the feed tray. FIG. 12 shows a relation between oil viscosity and flow rate at which leakage starts. The flow rate at which leakage starts decreases with increasing oil viscosity. These factors must be logically considered at the design stage.

The method of supplying toner while rotating the patterned roller is very effective method, because the method provide a great margin in relation to toner leakage. Our experiments indicate that because toner tends to follow the circumferential movement of the patterned roller even when the toner feed tray assumes a slightly tilted posture, leakage can scarcely occur.

Generally, in a color electrophotographic apparatus, one developing unit must be provided for each color. Assume that these developing units dedicated one to each color are arranged along the circumference of, for example, a photosensitive drum or a transfer drum. Such an arrangement would result in a complex apparatus structure, because the individual developing units must have different structures, depending on their installation angles; i.e., due to the restriction imposed on the installation angles of respective toner feed trays. However, the method of supplying toner while rotating the patterned roller mitigates the restriction imposed on the installation angles of respective toner feed trays. Therefore, even when developing units for respective colors are installed at different angles, toner can be supplied by use of a structure common among the colors.

Figure 16:
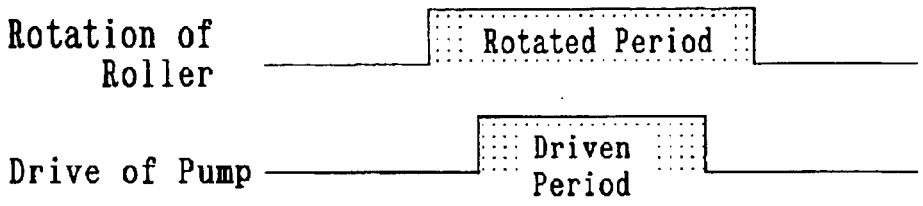
FIG. 16 is a diagram showing the timing of control of a pump for supplying a liquid toner.

Needless to say, since the feed tray is not closed by means of sealing, when the pattern roller is stopped, toner leaks from the feed tray by means of free fall, depending on the installation angle of the feed tray. This toner leakage occurring when the patterned roller is stopped can be prevented by controlling the supply of toner in accordance with a pump control timing shown in FIG. 16.

1. Start of Toner Supply:

First, rotate the patterned roller.

Then, drive a toner supply pump to supply toner.

After toner has been applied to the entire effective circumferential surface of the patterned roller, bring the patterned roller in contact with the developing roller, to thereby supply toner thereto.

2. Stop of Toner Supply:

First, stop driving the toner supply pump, to thereby stop the supply of toner.

Retract the patterned roller from the developing roller when the toner feed tray becomes empty of toner.

stop rotation of the patterned roller.

Determination as to whether or not the toner feed tray is empty can be achieved by monitoring the toner supply flow rate and the rpm of the patterned roller. The amount of toner in the toner feed tray remains constant by virtue of the toner circulating structure of the toner feed tray as described above. Further, the patterned roller supplies toner to the developing roller at a constant rate. Therefore, determination as to whether or not toner remains in the toner feed tray can be performed by monitoring the toner supply flow rate and the rpm of the patterned roller. This method enables obtainment of a structure which prevents leakage attributable to inclination of the toner feed tray, without sealing the toner flow channel of the toner feed tray.

The scraper blade contacting the patterned roller functions to scrape off excessive toner bulging from the cells of the patterned roller. In the absence of this scraper blade, supply of a constant amount of toner cannot be guaranteed even if the patterned roller has engraved cells. In order to realize stable and reliable contact between the scraper blade and the patterned roller, a pushing force is applied to the toner feed tray by use of the resilience of a spring, and the scraper blade is brought into contact with the patterned roller via the toner feed tray. Alternatively, as shown in FIG. 10, a pushing force may be applied directly to the scraper blade by use of the resilience of a spring to thereby bring the scraper blade into contact with the patterned roller.

Further, for the purpose of preventing leakage of toner from the contact zone between the scraper blade and the toner feed tray or the opposite end sides of the patterned roller, an elastic material, such as urethane rubber or closed-cell foamed sponge, is employed so as to enhance liquid-tightness. However, in this case, for the above-mentioned reasons the elastic material cannot be brought into contact with the circumferential surface of the patterned roller, at least within the range of the effective image bearing area.

Figure 13:
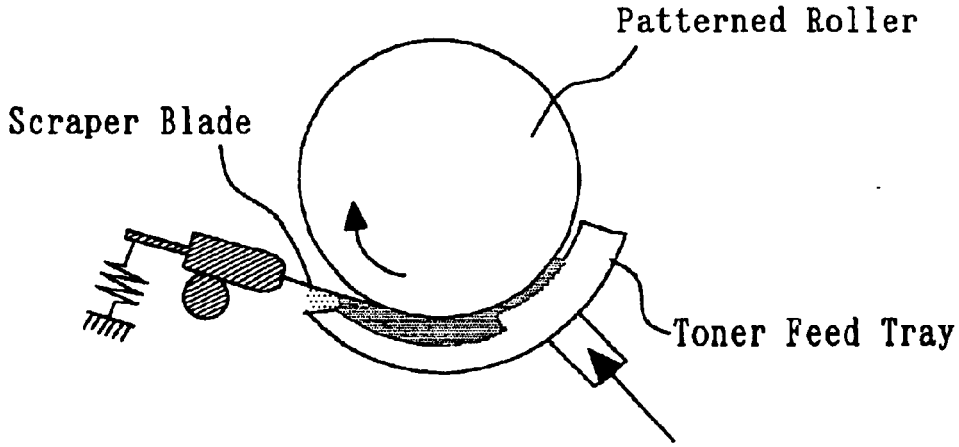
FIG. 13 is a view showing a third example of toner supply arrangement of the electrophotographic apparatus according to the present invention.

FIG. 13 shows a third example of the toner supply arrangement of the electrophotographic apparatus according to the present invention. In the illustrated example, the toner flow channel between the patterned roller and the toner feed tray is narrowed at the upstream-side portion of the patterned roller. The toner flow channel of the toner feed tray has an enlarged portion for spreading liquid toner along the longitudinal direction (axial direction) of the patterned roller, and a narrowed portion for preventing toner leakage. The operation of the toner supply arrangement when the patterned roller is out of rotation and the operation of the arrangement when the patterned roller is in rotation will now be described more with reference to FIGS. 14 and 15, respectively.

Figure 14:
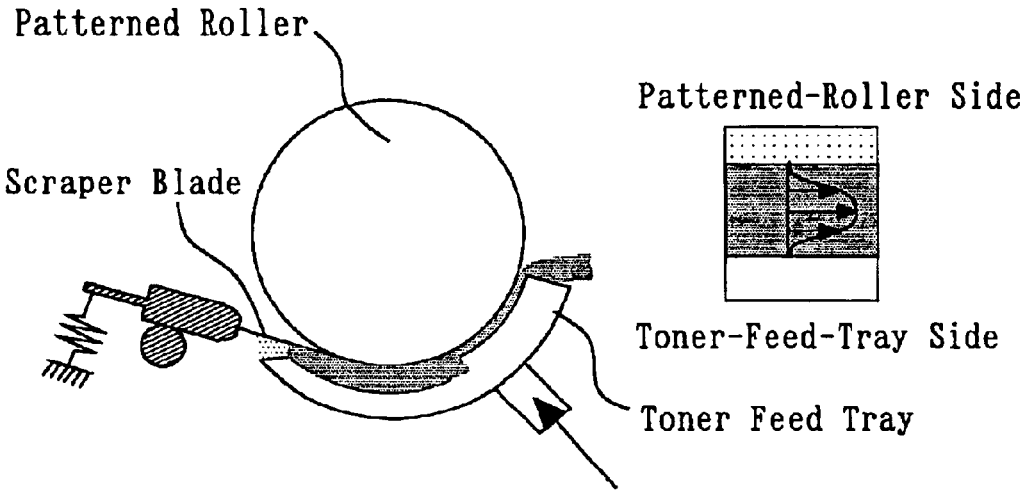
FIG. 14 is an illustration showing the operation of the developing unit when a patterned roller is out of rotation in the third example depicted in FIG. 13.

The right side of FIG. 14 shows a toner speed profile at the narrowed channel portion when the patterned roller is stopped. Since the narrowed channel portion is not statically sealed despite being narrow, flowing toner is prone to leak from the small gap when pressure is applied to the toner. Therefore, when a pump is started, the following procedure is performed in order to feed toner while preventing such leakage. Specifically, the patterned roller is first rotated so as to generate a force enclosing toner toward the center of the toner feed tray, and the pump is then started.

Figure 15:
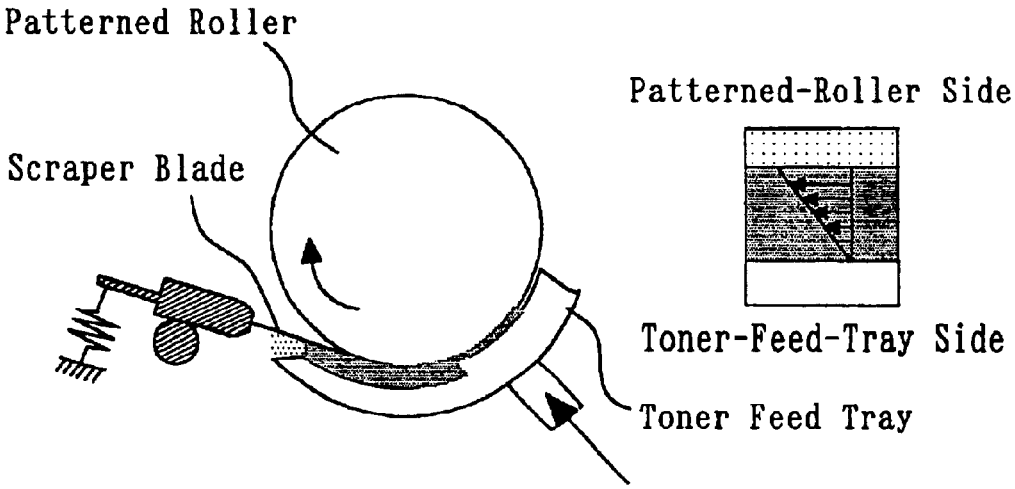
FIG. 15 is an illustration showing the operation of the developing unit when the patterned roller is in rotation in the third example depicted in FIG. 13.

When the patterned roller is in rotation, toner assumes a toner speed profile as shown in the right side in FIG. 15. Namely, this speed profile indicates that the toner speed increases linearly within the range of zero at the surface of the fixed toner feed tray to the circumferential speed of the patterned roller. So long as this speed profile is maintained, toner does not leak. However, when the pressure for feeding toner into the toner feed tray becomes high, this speed profile collapses, resulting in leakage of toner. Generally, the higher the viscosity, the greater the flow resistance of the discharge pipe; consequently, internal pressure of the toner feed tray becomes high, so that toner is prone to leak.

As described hereinabove, in the electrophotographic apparatus of the present invention, when a toner applicator roller assumes the form of a patterned roller having a pattern of cells engraved in its circumferential surface, nothing that can come in contact with the circumferential surface is present thereon, except for a developing roller and a scraper blade, so that toner concentration cannot change. Therefore, toner can be supplied to a toner supply section of a developing unit at a sufficient rate, while preventing deterioration of image quality, stagnation of toner, and leakage of toner.

Further, the present invention enables supply of toner by use of a structure common among required colors while maintaining the structure simple, even in the case in which developing units are arranged in number equal to the required colors, and restriction is imposed on the installation angle of each toner supply tray in accordance with the installation angle of the corresponding developing unit.

INDUSTRIAL APPLICABILITY

The configuration of the bias blade (sheet) according to the present invention increases the contact area of the bias blade (sheet), to thereby enable the process to be performed at a higher speed. It was confirmed experimentally that the blade can cope with a process speed of 500 mm/s. Moreover, conceivably, the blade can cope with a process speed of 1000 mm/s upon suppression of internal mechanical vibration of developing units attributable to operation at increased speed, proper selection of toner mobility, and adjustment of bias voltage to be applied. For example, when a process speed over 500 mm/s is realized, the printing speed can exceed 100 PPM, which should enable penetration of the professional offset printing market, which is a very lucrative market.

Further, since the level of electric charge of toner particles directly influences the image quality of development, stabilized voltage supply from the bias blade is required in order to make the level of electric charge of toner particles apparently stable. In this regard, the present invention enhance the effect of injecting electric charge into toner particles by increasing the nip width, to thereby increase the allowable range of toner.

Still further, in the present invention, since the bias blade can have an increased contact area, toner particles can be cohered electrically into a film shape. So long as the film-like toner layer offers a proper resistance against rupture and separation, an improved solution for rivulets can be achieved. Conventionally, the bias voltage must be increased in order to render the effect of an electrical field apparently large in order to minimize rivulets; in practice, however, increasing the bias voltage is difficult to attain within the range over 1000 V, partially because of problems such as undue discharging, and consequently only an electric field of insufficient strength can be applied. In contrast, the present invention enables achievement of a desired effect with a lower voltage by means of increasing the contact area or nip width and hence minimizing rivulets.

What is claimed is:

1. A developing unit for a liquid-development process in which a developer bearer body carrying a toner layer of liquid developer formed thereon is disposed to face an image bearer body in such a manner that toner particles of the liquid developer are caused to adhere to the image bearer body in a selective pattern corresponding to a recorded latent image, comprising an electrode module in the form of a flexible sheet which is adapted to contact the toner layer on said developer bearer body prior to development and to which a bias voltage is applied;

wherein said electrode module separates the toner layer largely into a toner-rich layer and a carrier-rich layer by utilizing electrical migration occurring in the toner layer when an electric field is applied to the toner layer on the basis of the bias voltage; and wherein said electrode module is constructed in such a manner that said sheet is pulled toward a surface of said developer bearer body by a force attributable to surface tension and/or wetting characteristic of the liquid developer existing between said sheet and said developer carrying body, whereby said sheet comes into contact with the surface of the developer bearer body.

2. A developing unit for a liquid-development process according to claim 1, wherein a circuit for applying the bias voltage to said electrode module includes a current limit circuit.

3. A developing unit for a liquid-development process according to claim 1, wherein said sheet is formed of a thin metal plate whose electrical resistance is substantially zero.

4. A developing unit for a liquid-development process according to claim 1, wherein said sheet is formed of an electrically conductive polymer.

5. A developing unit for a liquid-development process according to claim 4, wherein carbon is added to said polymer in order to impart electrical conductivity to said sheet.

6. A developing unit for a liquid-development process according to claim 4, wherein a lithium salt, sodium salt or ammonium salt is incorporated into said polymer in order to impart ion-induced electrical conductivity to said sheet.

7. A developing unit for a liquid-development process according to claim 1, wherein said electrode module includes an intermediate/high resistance layer and a low-resistance layer formed on a backside of said intermediate/high resistance layer; and said intermediate/high resistance layer has an intermediate or high resistance greater than that of said low-resistance layer.

8. A developing unit for a liquid-development process according to claim 7, wherein said low-resistance layer is formed of a flexible, electrically conductive adhesive.

9. A developing unit for a liquid-development process according to claim 8, wherein said low-resistance layer and said intermediate/high resistance layer are spaced from each other by a predetermined distance, and said distance is adjustable in order to adjust an apparent resistance of said electrode module.

10. A developing unit for a liquid-development process according to claim 7, wherein said low-resistance layer is formed of a flexible metal plate.

11. A developing unit for a liquid-development process according to claim 1, wherein said bias voltage is applied to said flexible sheet in such a manner that a stronger electric field is generated at a tip portion of said sheet as compared with a toner-inlet side of said sheet.

12. A developing unit for a liquid-development process according to claim 1, wherein said flexible sheet is in the form of a belt whose belly portion is pressed against said developer bearer body; and voltages are applied to a pair of electrodes which support said belt in order to produce a potential difference therebetween, to thereby change the electric field applied to the toner particles from a toner-outlet side toward said toner-inlet side.

13. A developing unit for a liquid-development process according to claim 1, wherein said flexible sheet has a guide for suppressing fluttering movement of said flexible sheet, which movement would otherwise occur when the toner layer is not present on said developer bearer body, in order to stabilize position of said flexible sheet.

14. A developing unit for a liquid-development process according to claim 1, wherein said developing unit further includes a patterned roller adapted to apply the liquid developer to said developer bearer body while rotating in contact therewith, a toner feed tray adapted to supply the liquid developer to a surface of said patterned roller, and control means for controlling the rotation of said patterned roller and the supply of said liquid developer;

said patterned roller has a structure such that its circumferential surface is free from contact with any of components of said developing unit, except said developer bearer body and a scraper blade;

said toner feed tray has a length greater than the transverse length of said patterned roller and a width for covering a portion of the circumference of said patterned roller, is disposed to face the surface of said patterned roller with a gap formed therebetween, and is configured to enable said liquid developer to be fed to said gap and discharged from said gap in a circulating manner; and when said liquid developer is supplied to said toner feed tray, said control means effects the supply while rotating said patterned roller, in order to convey said liquid developer onto said patterned roller without any leakage of said liquid developer from said toner feed tray.

15. A developing unit for a liquid-development process according to claim 14, wherein, when supply of said liquid developer to said developer bearer body is started, said control means rotates said patterned roller, then supplies said liquid developer to said toner feed tray, and, after said liquid developer is spread throughout the entire area of said patterned roller, brings said developer bearer body and said patterned roller into contact with each other to thereby supply said liquid developer onto said developer bearer body; and, when supply of said liquid developer becomes unnecessary, said controller stops the supply of said liquid developer to said toner feed tray and discharges toner remaining inside the developing unit.

16. A developing unit for a liquid-development process according to claim 14, wherein for controlling the supply of said liquid developer to said toner feed tray, said control means adjusts the supply of the toner by reading rpm of said patterned roller and grasping an amount of toner consumption on the basis of the read rpm of said patterned roller.

17. A developing unit for a liquid-development process according to claim 14, wherein said toner feed tray is constructed so as to narrow a flow channel between the surface of said patterned roller and said toner feed tray at an upstream side of said patterned roller.

* * * * *

UNITED STATES PATENT AND TRADEMARK OFFICE

CERTIFICATE OF CORRECTION

PATENT NO. : 6,842,599 B2
DATED : January 11, 2005
INVENTOR(S) : Hideaki Shibata et al.

It is certified that error appears in the above-identified patent and that said Letters Patent is hereby corrected as shown below:

Title page,
Item [54], Title, change "LIQUID DEVELOPING SYSTEM DEVELOPING DEVICE" to -- DEVELOPING UNIT FOR LIQUID DEVELOPMENT PROCESS --;
Item [73], Inventors, please add -- Eiji Yamaguchi, Nanatsuka –machi (JP) --.

Column 5,
Line 59, change "mPa.S" to -- mPa•S --.

Signed and Sealed this

Twenty-seventh Day of September, 2005

JON W. DUDAS
*Director of the United States Patent and Trademark Office*